US010381186B2

(12) United States Patent
Douglass

(10) Patent No.: US 10,381,186 B2
(45) Date of Patent: Aug. 13, 2019

(54) HIGH VOLTAGE COMPACT FUSIBLE DISCONNECT SWITCH DEVICE WITH MAGNETIC ARC DEFLECTION ASSEMBLY

(71) Applicant: EATON INTELLIGENT POWER LIMITED, Dublin (IE)

(72) Inventor: Robert Stephen Douglass, Wildwood, MO (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/227,053

(22) Filed: Dec. 20, 2018

(65) Prior Publication Data

US 2019/0148100 A1 May 16, 2019

Related U.S. Application Data

(63) Continuation of application No. 15/838,656, filed on Dec. 12, 2017, now Pat. No. 10,224,169, which is a (Continued)

(51) Int. Cl.
*H01H 85/00* (2006.01)
*H01H 89/04* (2006.01)

(Continued)

(52) U.S. Cl.
CPC ..... *H01H 89/04* (2013.01); *H01H 1/20* (2013.01); *H01H 1/36* (2013.01); *H01H 9/104* (2013.01);

(Continued)

(58) Field of Classification Search
CPC .. H01H 89/04; H01H 85/0241; H01H 85/153; H01H 85/165; H01H 85/38; H01H 1/20; H01H 1/36

(Continued)

(56) References Cited

U.S. PATENT DOCUMENTS 685,766 A 11/1901 Jones
3,684,849 A 8/1972 Zubaty (Continued)

FOREIGN PATENT DOCUMENTS

AU 6805098 A 12/1998
CA 905466 7/1972

(Continued)

OTHER PUBLICATIONS

International Search Report and Written Opinion for International Application PCT/US2016/020199, dated May 24, 2016, 11 pages.

(Continued)

*Primary Examiner* — Anthony M Haughton
(74) *Attorney, Agent, or Firm* — Armstrong Teasdale LLP

(57) ABSTRACT

A compact fusible disconnect switch device includes a magnetic arc deflection assembly including pairs of magnets disposed about a mechanical switch contact assembly. The magnetic arc deflection assembly facilitates reliable connection and disconnection of DC circuitry operating at a voltage well above 125 VDC with reduced arcing intensity and duration. The pairs of magnets may apply magnetic fields in directions opposing one another to deflect electrical arcs in different directions at different locations in the mechanical switch contact assembly to facilitate high voltage DC switching operation.

20 Claims, 5 Drawing Sheets

Related U.S. Application Data continuation of application No. 15/337,335, filed on Oct. 28, 2016, now Pat. No. 9,881,761, which is a continuation of application No. 14/640,678, filed on Mar. 6, 2015, now Pat. No. 9,552,951.

(51) Int. Cl.

| | |
|---|---|
| ***H01H 21/16*** | (2006.01) |
| ***H01H 85/38*** | (2006.01) |
| ***H01H 85/165*** | (2006.01) |
| ***H01H 19/14*** | (2006.01) |
| ***H01H 85/02*** | (2006.01) |
| ***H01H 9/44*** | (2006.01) |
| ***H01H 9/10*** | (2006.01) |
| ***H01H 1/20*** | (2006.01) |
| ***H01H 1/36*** | (2006.01) |
| ***H01H 85/153*** | (2006.01) |
| ***H01H 33/18*** | (2006.01) |

(52) U.S. Cl.

CPC ..... *H01H 9/443* (2013.01); *H01H 19/14* (2013.01); *H01H 21/16* (2013.01); *H01H 33/182* (2013.01); *H01H 85/0241* (2013.01); *H01H 85/153* (2013.01); *H01H 85/165* (2013.01); *H01H 85/38* (2013.01); *H01H 2085/386* (2013.01)

(58) Field of Classification Search

USPC ..... 337/1, 2, 10, 98, 198, 14, 11

See application file for complete search history.

(56) References Cited

U.S. PATENT DOCUMENTS

| | | | | |
|---|---|---|---|---|
| 4,367,448 | A * | 1/1983 | Nishizako | H01H 9/443 218/26 |
| 4,514,716 | A | 4/1985 | De Araujo | |
| 4,752,660 | A * | 6/1988 | Yokoyama | H01H 9/32 218/117 |
| 4,962,406 | A | 10/1990 | Walker et al. | |
| 5,291,167 | A | 3/1994 | Richter | |
| 5,588,876 | A | 12/1996 | Hayes et al. | |
| 5,592,079 | A * | 1/1997 | Scheel | G01B 7/30 324/207.13 |
| 5,633,483 | A | 5/1997 | Oster et al. | |
| 5,793,275 | A | 8/1998 | Iversen | |
| 5,920,131 | A * | 7/1999 | Platt | F24C 7/082 307/104 |
| 6,008,459 | A | 12/1999 | Faber et al. | |
| 6,188,332 | B1 * | 2/2001 | Scarlata | G01D 5/145 200/19.07 |
| 6,498,326 | B1 * | 12/2002 | Knappe | H05B 3/746 219/507 |
| 6,700,466 | B1 * | 3/2004 | Yamamoto | H01H 9/302 218/156 |
| 6,809,282 | B2 | 10/2004 | Fasano | |
| 6,812,435 | B2 * | 11/2004 | Schilling | F24C 7/083 200/18 |
| 6,838,785 | B2 * | 1/2005 | Schilling | F24C 7/083 219/660 |
| 8,106,733 | B2 * | 1/2012 | Nakasuji | H01H 36/0066 219/457.1 |
| 8,334,740 | B2 | 12/2012 | Annis et al. | |
| 8,519,292 | B2 | 8/2013 | Domejean | |
| 8,661,719 | B2 * | 3/2014 | Hughes | G09F 1/04 40/124.02 |
| 8,835,814 | B2 * | 9/2014 | Apetauer | F24C 7/083 219/443.1 |
| 2003/0224737 | A1 * | 12/2003 | Yokoji | H01H 5/02 455/90.3 |
| 2004/0150504 | A1 * | 8/2004 | Nicholson | H01H 37/58 337/54 |
| 2006/0055498 | A1 | 3/2006 | Darr et al. | |
| 2006/0125596 | A1 | 6/2006 | Darr et al. | |
| 2007/0188290 | A1 * | 8/2007 | Nakasuji | H01H 36/0066 337/1 |
| 2008/0296264 | A1 | 12/2008 | Schulz et al. | |
| 2009/0128280 | A1 | 5/2009 | Darr et al. | |
| 2009/0321233 | A1 | 12/2009 | Ferree | |
| 2011/0169599 | A1 | 7/2011 | Darr et al. | |
| 2011/0193675 | A1 * | 8/2011 | Darr | H01H 1/20 337/187 |
| 2012/0268233 | A1 * | 10/2012 | Weber | H01H 9/32 337/5 |
| 2013/0057369 | A1 * | 3/2013 | Yano | H01H 1/66 335/156 |
| 2013/0075367 | A1 | 3/2013 | Erikkson et al. | |
| 2013/0106543 | A1 | 5/2013 | Isozaki et al. | |
| 2013/0112655 | A1 * | 5/2013 | Theisen | H01H 1/2066 218/23 |
| 2013/0228551 | A1 | 9/2013 | Asokan et al. | |
| 2013/0264311 | A1 | 10/2013 | Lang et al. | |
| 2014/0014622 | A1 | 1/2014 | Naka et al. | |
| 2015/0054605 | A1 | 2/2015 | Kubono et al. | |
| 2015/0114934 | A1 | 4/2015 | Juds et al. | |

FOREIGN PATENT DOCUMENTS

| | | | |
|---|---|---|---|
| CA | 2820116 | A1 | 6/2012 |
| CN | 201117605 | Y | 9/2008 |
| CN | 101315852 | A | 12/2008 |
| CN | 201430111 | Y | 3/2010 |
| CN | 102592910 | A | 7/2012 |
| CN | 202736866 | U | 2/2013 |
| DE | 2434897 | A1 | 2/1976 |
| DE | 102012214881 | A1 | 2/2014 |
| DE | 102012223168 | A1 | 3/2014 |
| EP | 2605265 | A1 | 6/2013 |
| EP | 2690639 | A1 | 1/2014 |
| ES | 2437580 | T3 | 1/2014 |
| GB | 619239 | | 3/1949 |
| IN | 697/MUM/2011 | | 7/2013 |
| JP | H11329206 | A | 11/1999 |
| JP | H111339605 | A | 12/1999 |
| JP | 2002260475 | A | 9/2002 |
| JP | 2007324038 | A | 12/2007 |
| JP | 2008300094 | A | 12/2008 |
| JP | 2011150983 | A | 8/2011 |
| JP | 2012146472 | A | 8/2012 |
| JP | 5303022 | B2 | 10/2013 |
| JP | 2013235748 | A | 11/2013 |
| JP | 5368150 | B2 | 12/2013 |
| JP | 2013242977 | A | 12/2013 |
| JP | 2014056731 | A | 3/2014 |
| KR | 101031975 | B1 | 5/2011 |
| KR | 101214007 | B1 | 12/2012 |
| WO | 2011127654 | A1 | 10/2011 |
| WO | 2014039162 | A1 | 3/2014 |

OTHER PUBLICATIONS

International Search Report and Written Opinion for International Application PCT/US2016/022627, dated Mar. 16, 2016, 16 pages.

Final Office Action of U.S. Appl. No. 15/151,949, dated Jul. 26, 2018, 24 pages.

* cited by examiner

HIGH VOLTAGE COMPACT FUSIBLE DISCONNECT SWITCH DEVICE WITH MAGNETIC ARC DEFLECTION ASSEMBLY

CROSS REFERENCE TO RELATED APPLICATIONS

This application is a continuation application of U.S. application Ser. No. 15/838,656 filed Dec. 12, 2017 which is a continuation application of U.S. application Ser. No. 15/337,335 filed Oct. 28, 2016 and now issued U.S. Pat. No. 9,881,761, which is a continuation of U.S. application Ser. No. 14/640,678 filed Mar. 6, 2015 and now issued U.S. Pat. No. 9,552,951, the disclosures of which are hereby incorporated by reference in their entirety.

BACKGROUND OF THE INVENTION

The field of the invention relates generally to fusible circuit protection devices, and more specifically to fusible disconnect switch devices configured for higher voltage direct current (DC) industrial applications.

Fuses are widely used as overcurrent protection devices to prevent costly damage to electrical circuits. Fuse terminals typically form an electrical connection between an electrical power source and an electrical component or a combination of components arranged in an electrical circuit. One or more fusible links or elements, or a fuse element assembly, is connected between the fuse terminals, so that when electrical current flowing through the fuse exceeds a predetermined limit, the fusible elements melt and opens one or more circuits through the fuse to prevent electrical component damage.

A variety of fusible disconnect switch devices are known in the art wherein fused output power may be selectively switched from a power supply input. Existing fusible disconnect switch devices, however, have not completely met the needs of the marketplace and improvements are desired. In particular, higher voltage, direct applications present additional demands on fusible switch disconnect devices that are not well met by existing fusible disconnect devices.

BRIEF DESCRIPTION OF THE DRAWINGS

Non-limiting and non-exhaustive embodiments are described with reference to the following Figures, wherein like reference numerals refer to like parts throughout the various views unless otherwise specified.

DETAILED DESCRIPTION OF THE INVENTION

Figure 1:
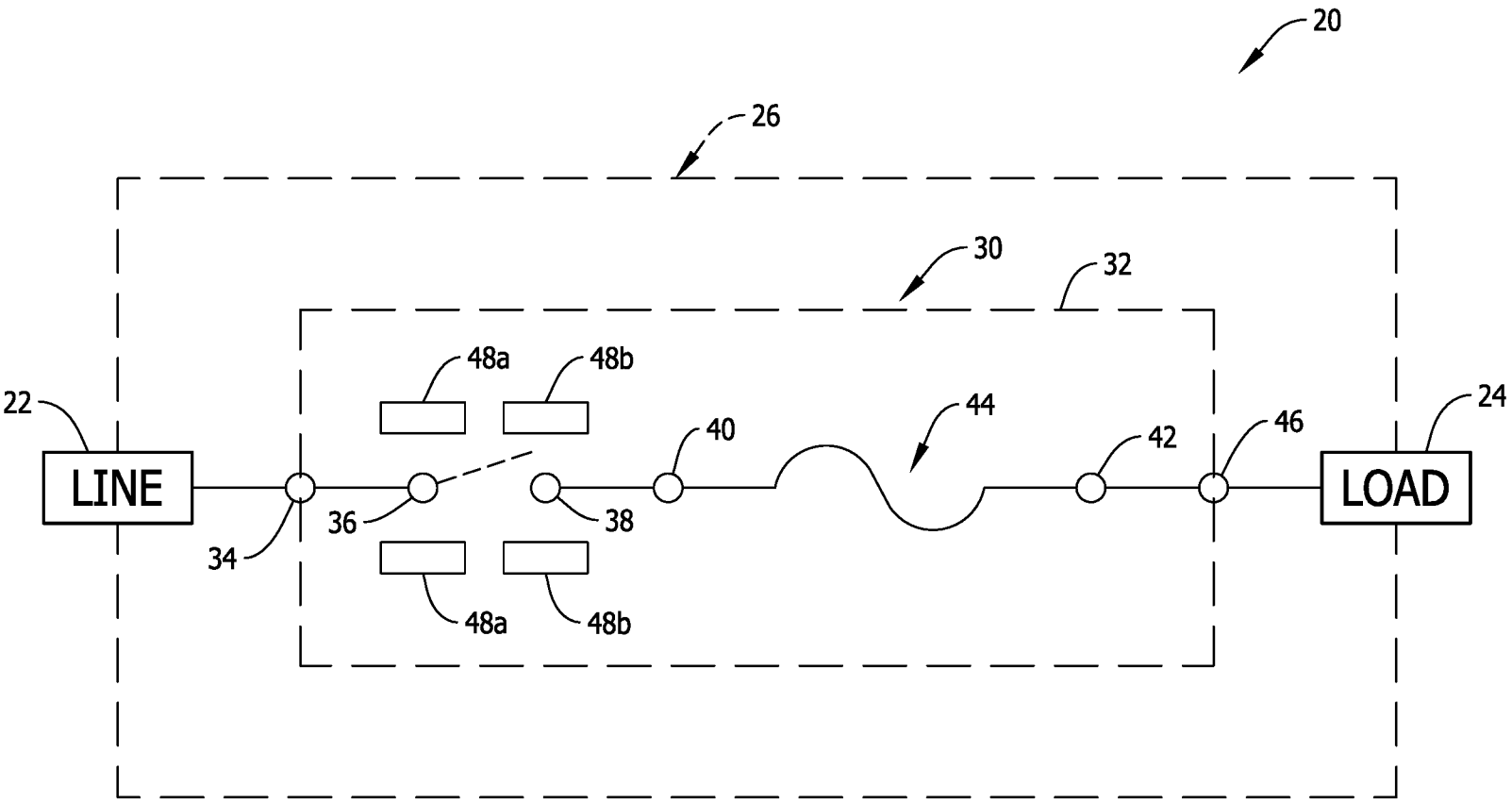
FIG. 1 is a circuit schematic of an exemplary electrical power distribution system including a fusible disconnect switch device formed in accordance with an exemplary embodiment of the present invention.

FIG. 1 schematically illustrates an electrical power system 20 for supplying electrical power from a power supply or line-side circuitry 22 to power receiving or load-side circuitry 24. In contemplated embodiments the line-side circuitry 22 and load-side circuitry 24 may be associated with a panelboard 26 that includes a fusible switching disconnect device 30. While one fusible switching disconnect device 30 is shown, it is contemplated that in a typical installation a plurality of fusible switching disconnect devices 30 would be provided in the panel board 26 that each respectively receives input power from the line-side circuitry 22 via, for example, a bus bar (not shown), and outputs electrical power to one or more of various different electrical loads 24 associated with branch circuits of the larger electrical power system 20.

The fusible switching disconnect device 30 may be configured as a compact fusible switching disconnect device such as those described further below that advantageously combine switching capability and enhanced fusible circuit protection in a single, compact switch housing 32. As shown in FIG. 1, the fusible switching disconnect device 30 defines a circuit path through the switch housing 32 between the line-side circuitry 22 and the load-side circuitry 24. The circuit path of the fusible switching disconnect device 30 includes, as shown in FIG. 1, a line-side connecting terminal 34, switchable contacts 36 and 38, fuse contact terminals 40 and 42, a removable overcurrent protection fuse 44 connected between the fuse contact terminals 40 and 42, and a load-side connecting terminal 46. Each of the elements 34, 36, 38, 40, 42 and 46 that define the circuit path are included in the housing 32 while the overcurrent protection fuse 44 is separately provided but used in combination with the housing 32 and the conductive elements 34, 36, 38, 40, 42 and 46 in the switch housing 32.

The switch contacts 36, 38 are movable between opened and closed positions to electrically connect or isolate the line-side connecting terminal 34 and the fuse contact terminal 40 and hence connect or disconnect the load-side circuitry 24 from the line-side circuitry 22 when desired. When the fusible switching disconnect device 30 is connected to energized line-side circuitry 22, and also when the switch contacts 36, 38 are closed as shown in FIG. 1 and the fuse 44 is intact, electrical current flows through the line-side connecting terminal 34 of the fusible switching disconnect device 30 and through the switchable contacts 36 and 38, to and through the fuse contact terminal 40 and the fuse 44 to the fuse contact terminal 42, and to and through the load-side connecting terminal 46 to the load. When the switch contacts 36, 38 are opened, an open circuit is established between them in the switch housing 32 of the fusible switching disconnect device 30 and the load-side circuitry 24 is electrically isolated or disconnected from the line-side circuitry 22 via the fusible switching disconnect device 30. When the contacts 36, 38 are again closed, electrical current flow resumes through the current path in the fusible switching disconnect device 30 and the load-side circuitry 24 is again connected to the line-side circuitry 22 through the fusible switching disconnect device 30.

When the overcurrent protection fuse 44 is subjected to a predetermined electrical current condition when the switch contacts 38, 38 are closed, however, the overcurrent protection fuse 44, and specifically the fusible element (or fusible elements) therein is configured to permanently open or fail to conduct current any longer, creating an open circuit between the fuse contact terminals 40 and 42. When the overcurrent protection fuse 44 opens in such a manner, current flow through the fusible switching disconnect device 30 is interrupted and possible damage to the load-side circuitry 24 is avoided. In one contemplated embodiment, the fuse 44 may be a rectangular fuse module such as a CUBEFuse™ power fuse module commercially available from Bussmann by Eaton of St. Louis, Mo. In other embodiments, the overcurrent protection fuse 44 may be a cylindrical fuse such as a Class CC fuse, a so-called Midget fuse, or an IEC 10×38 fuse also available from Bussmann by Eaton.

Because the overcurrent protection fuse 44 permanently opens, the overcurrent protection fuse 44 must be replaced to once again complete the current path between the fuse contact terminals 40 and 42 in the fusible switching disconnect device 30 such the power can again be supplied to the load-side circuitry 24 via the fusible switching disconnect device 30. In this aspect, the fusible switching disconnect device 30 is contrasted with a circuit breaker device that is known to provide overcurrent protection via a resettable breaker element. At least in part because the device 30 does not involve or include a resettable circuit breaker element in the circuit path completed in the switch housing 32, the fusible switching disconnect device 30 is considerably smaller than an equivalently rated circuit breaker device providing similar overcurrent protection performance.

As compared to conventional arrangements wherein fusible devices are connected in series with separately packaged switching elements, the fusible switching disconnect device 30 is relatively compact and can provide substantial reduction in size and cost while providing comparable, if not superior, circuit protection performance.

When the compact fusible switching disconnect devices 30 are utilized in combination in a panelboard 26, current interruption ratings of the panelboard 26 may be increased while the size of the panelboard 26 may be simultaneously reduced. The compact fusible disconnect device 30 may advantageously accommodate fuses 44 without involving a separately provided fuse holder or fuse carrier that is found in certain types of conventional fusible switch disconnect devices. The compact fusible disconnect device 30 may also be configured to establish electrical connection to the fuse contact terminals 40, 42 without fastening of the fuse 44 to the line and load-side terminals with separate fasteners, and therefore provide still further benefits by eliminating certain components of conventional fusible disconnect constructions while simultaneously providing a lower cost, yet easier to use fusible circuit protection product 30.

Presently available compact fusible disconnect devices such as Compact Circuit Protection (CCP) devices available from Bussmann by Eaton of St. Louis, Mo. provide the functionality and benefits described thus far in relation to the switch housing 32 and the associated terminals and contacts, but are nonetheless limited in some aspects for particular applications involving higher voltage direct current (DC) power systems. More specifically, presently available compact fusible disconnect devices of otherwise similar type can safely break a DC circuit having a voltage potential of about 125 VDC or less. For DC power systems operating above 125 VDC, the arc energy associated with electrical arcing as the switch contacts 36, 38 are opened or closed increases considerably and exceeds the ability of presently available compact fusible disconnect devices to reliably withstand. Compact fusible disconnect devices are now desired that may operate not only at 125 VDC and above, but also at much higher DC voltages such as 400 VDC, 600 VDC and even 1000 VDC. Improvements are therefore desired.

To address arcing concerns of 125 VDC operation and above, the compact fusible disconnect device 30 of the invention includes a set of magnets 48 arranged to provide an arc deflecting force to more quickly extinguish the arc and its intensity as switching occurs in the switch housing 32. In contemplated embodiments, the set of magnets 48 includes a first pair of magnets 48*a* and a second pair of magnets 48*b* arranged to provide an arc deflecting force proximate each of the switch contacts 36 and 38. Also in contemplated embodiments, the first pair of magnets 48*a* and the second pair of magnets 48*b* are arranged to provide oppositely directed arc deflection forces proximate each switch contact 36 and 38. By providing two switch contacts 36, 38, the electrical arc is divided over the two locations corresponding to each contact 36 and 38, and via the pairs of magnets 48*a*, 48*b* providing the arc deflecting force on each respective contact 36 and 38, electrical arcing is less severe and shorter in duration than it otherwise would be, allowing the compact fusible disconnect device 30 to safely and capably operate to disconnect the line-side circuitry 22 and electrically isolate the load-side circuitry 24 at much higher operating DC voltages beyond the capability of known fusible switch disconnect devices. Voltage potentials as high as 1000 VDC may be reliably and safely disconnected by virtue of the set of magnets 48. In other embodiments, DC voltage potential breaking may still be improved, but to a lesser extent, by providing one pair of magnets instead of two.

Figure 2:
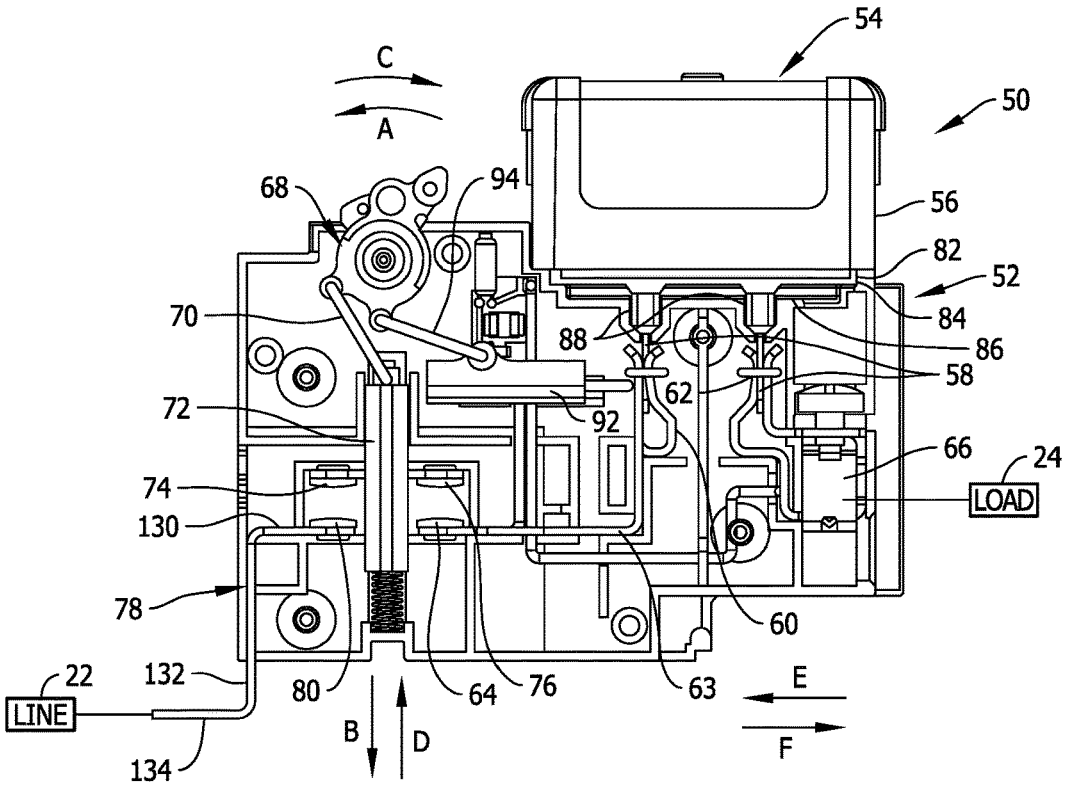
FIG. 2 is a partial longitudinal side elevational view of a first embodiment of a fusible disconnect switch device for the electrical power distribution system shown in FIG. 1.
Figure 3:
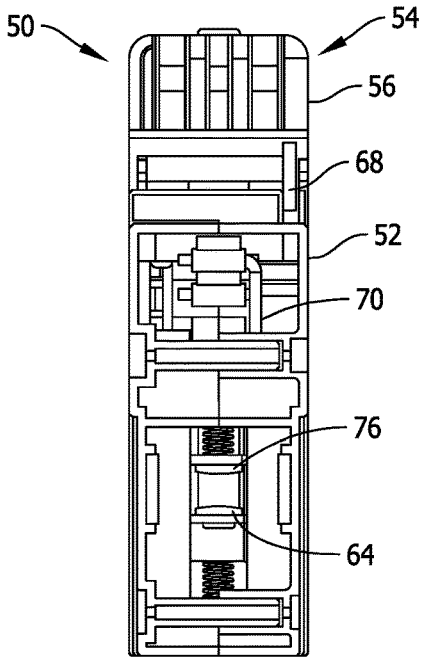
FIG. 3 is a partial lateral sectional view of the fusible disconnect switch device shown in FIG. 2.

FIGS. 2 and 3 illustrate a more specific example of a compact fusible switch disconnect device assembly 50 that provides the functionality described above in relation to the compact fusible disconnect device 30. As shown in FIGS. 2 and 3, the fusible switch disconnect device assembly 50 includes a nonconductive switch housing 52 configured or adapted to receive a retractable rectangular fuse module 54. The fuse module 54 is a known assembly including a rectangular housing 56, and terminal blades 58 extending from the housing 56. A primary fuse element or fuse assembly is located within the housing 56 and is electrically connected between the terminal blades 58. Such fuse modules 54 are known and in one embodiment the rectangular fuse module is a CUBEFuse™ power fuse module commercially available from Bussmann by Eaton of St. Louis, Mo.

A line-side fuse clip 60 may be situated within the switch housing 52 and may receive one of the terminal blades 58 of the fuse module 54. A load-side fuse clip 62 may also be situated within the switch housing 52 and may receive the other of the fuse terminal blades 58. The line-side fuse clip 60 may be electrically connected to a line-side terminal 63 including a stationary switch contact 64. The load-side fuse clip 62 may be electrically connected to a load-side terminal 66.

A rotary switch actuator 68 is further provided on the switch housing 52, and is mechanically coupled to an actuator link 70 that, in turn is coupled to a sliding actuator bar 72. The actuator bar 72 carries a pair of switch contacts 74 and 76. A load-side terminal 78 including a stationary contact 80 is also provided. Electrical connection to power supply or line-side circuitry 22 may be accomplished in a known manner using the line-side terminal 78, and an electrical connection to load-side circuitry 24 may be accomplished in a known manner using the load-side terminal 66. A variety of connecting techniques are known (e.g., box lug terminals, screw clamp terminals, spring terminals, and the like) and may be utilized. The configuration of the line and load-side terminals 78 and 66 shown are exemplary only, and in the example of FIG. 2 the line and load-side terminals 78 and 66 are differently configured. In the embodiment illustrated, the line-side terminal 78 is configured as a panel mount clip (also shown in FIG. 7) while the load-side terminal 66 is configured as a box lug terminal. In alternative embodiments, however, the load-side terminal 66 and line-side terminal 78 may be configured to be the same (e.g., both may be configured as box lug terminals or as another terminal configuration as desired).

Disconnect switching may be accomplished by rotating the switch actuator 68 in the direction of arrow A, causing the actuator link 70 to move the sliding bar 72 linearly in the direction of arrow B and moving the switch contacts 74 and 76 toward the stationary contacts 64 and 80. Eventually, the switch contacts 74 and 76 become mechanically and electrically engaged to the stationary contacts 64 and 80 and a circuit path may be closed through the fuse 54 between the line and load terminals 78 and 66 when the fuse terminal blades 58 are received in the line and load-side fuse clips 60 and 62. This position, wherein the movable switch contacts 74 and 76 are mechanically and electrically connected to the stationary switch contacts 64 and 80 is referred to herein as a closed position wherein the fusible disconnect switch device 50 electrically connects the line-side circuitry 22 and the load-side circuitry 24 through the fuse 54.

When the actuator 68 is moved in the opposite direction indicated by arrow C in FIG. 3, the actuator link 70 causes the sliding bar 72 to move linearly in the direction of arrow D and pull the switch contacts 74 and 76 away from the stationary contacts 64 and 80 to open the circuit path through the fuse 54 as shown in FIG. 3. This position wherein the movable switch contacts 74 and 76 are mechanically and electrically separated from the stationary switch contacts 64 and 80 is referred to herein as an opened position wherein the fusible disconnect switch device 50 electrically disconnects the line-side circuitry 22 and the load-side circuitry 24.

As such, by moving the actuator 68 to a desired position to effect the opened or closed position of the switch contacts, the fuse 54 and associated load-side circuitry 24 may be connected and disconnected from the line-side circuitry 22 while the line-side circuitry 22 remains "live" in full power operation.

Additionally, the fuse module 54 may be simply plugged into the fuse clips 60, 62 or extracted therefrom to install or remove the fuse module 54 from the switch housing 52. The fuse housing 56 projects from the switch housing 52 and is open and accessible so that a person can grasp the fuse housing 56 by hand and pull it in the direction of arrow B to disengage the fuse terminal blades 58 from the line and load-side fuse clips 60 and 62 such that the fuse module 54 is completely released from the switch housing 52. Likewise, a replacement fuse module 54 can be grasped by hand and moved toward the switch housing 52 to engage the fuse terminal blades 58 to the line and load-side fuse clips 60 and 62.

Such plug-in connection and removal of the fuse module 54 advantageously facilitates quick and convenient installation and removal of the fuse 54 without requiring separately supplied fuse carrier elements and without requiring tools or fasteners common to other known disconnect devices. Also, the fuse terminal blades 58 project from a lower side of the fuse housing 56 that faces the switch housing 52. Moreover, the fuse terminal blades 58 extend in a generally parallel manner projecting away from the lower side of the fuse module 54 such that the fuse housing 56 (as well as a person's hand when handling it) is physically isolated from the conductive fuse terminals 58 and the conductive line and load-side fuse clips 60 and 62. The fuse module 54 is therefore touch safe (i.e., may be safely handled by hand without risk of electrical shock) when installing and removing the fuse 54.

Additionally, the disconnect device 50 is rather compact and can easily occupy less space in a fusible panelboard assembly, for example, than conventional in-line fuse and circuit breaker combinations. In particular, CUBEFuse™ power fuse modules occupy a smaller area, sometimes referred to as a footprint, in the panel assembly than non-rectangular fuses having comparable ratings and interruption capabilities. Reductions in the size of panelboards are therefore possible, with increased interruption capabilities.

In ordinary use, the circuit is preferably connected and disconnected at the switch contacts 64, 74, 76 and 80 rather than at the fuse clips 60 and 62. Electrical arcing that may occur when connecting/disconnecting the circuit may be contained at a location away from the fuse clips 60 and 62 to provide additional safety for persons installing, removing, or replacing fuses. By opening the disconnect module 50 with the switch actuator 68 before installing or removing the fuse module 54, any risk posed by electrical arcing or energized metal at the fuse and housing interface is eliminated. The disconnect module 50 is accordingly believed to be safer to use than many known fused disconnect switches.

The disconnect switching device 50 includes still further features, however, that improve the safety of the device 50 in the event that a person removes the fuse module 54 without operating the actuator 68 to disconnect the circuit through the fuse module 54.

As shown in FIG. 2, the switch housing 52 in one example includes an open ended receptacle or cavity 82 on an upper edge thereof that accepts a portion of the fuse housing 56 when the fuse module 54 is installed with the fuse terminal blades 58 engaged to the fuse clips 60, 62. The receptacle 82 is shallow in the embodiment depicted, such that the only a small portion of the fuse housing 56 is received therein, which facilitates the finger safe handling of the fuse module 54 for installation and removal without requiring tools. It is understood, however, that in other embodiments the fuse housing 56 need not project as greatly from the switch housing receptacle when installed, and indeed could even be substantially entirely contained with the switch housing 52 if desired.

In the exemplary embodiment shown, the fuse housing 56 includes a recessed guide rim 84 having a slightly smaller outer perimeter than a remainder of the fuse housing 56, and the guide rim 84 is seated in the switch housing receptacle 82 when the fuse module 54 is installed. It is understood, however, that the guide rim 84 may be considered entirely optional in another embodiment and need not be provided.

The switch housing receptacle 82 further includes a bottom surface 86, sometimes referred to as a floor, that includes first and second openings 88 formed therein and through which the fuse terminal blades 58 may be extended to engage them with the line and load-side fuse clips 60 and 62. In the example shown, the assembly further includes an interlock element 92 that is in turn coupled to the switch actuator 68 via a positioning arm or link 94. As the switch actuator 68 is rotated in the direction of arrow C to open the switch contacts 74 and 76, the link 94 pulls the interlock element 92 along a linear axis in the direction of arrow E away from the line-side fuse clip 60. In this state, the slidable plug-in connection of the fuse 54 and specifically line-side terminal blade 58 to the line-side fuse clip 60 is permitted, as well as removal of the line-side terminal blade 58 from the line-side fuse clip 60.

When the switch actuator 68 is rotated in the direction of arrow A, however, to the closed or "on" position wherein the switch contacts 74 and 76 are engaged with the stationary contacts 64 and 80, the interlock element 92 is slidably moved toward the line-side fuse clip 60 along the linear axis in the direction of arrow F toward the line-side fuse clip 60. An end of the interlock element is passed through an opening in the line-side terminal blade 58 as this happens and the line-side terminal blade 58 becomes effectively locked in place and frustrates any attempt to remove the fuse 54.

The switch actuator 68 simultaneously drives the sliding bar 72 along a first linear axis (i.e., a vertical axis in FIG. 2 as drawn) in the direction of arrow B or D and the slidable interlock element 92 along a second linear axis (i.e., a horizontal axis in FIG. 2 as drawn) in the direction of arrows E or F. Specifically, as the sliding bar 72 is moved in the direction of arrow B, the interlock element 92 is driven in the direction of arrow F toward the line-side fuse clip 60. Likewise, when the sliding bar 72 is moved in the direction of arrow D, the interlock element 92 is driven in the direction of arrow E away from the line-side fuse clip 60. The mutually perpendicular axes for the sliding bar 72 and the interlock element 92 is beneficial in that that the actuator 68 is stable in either the opened "off" position or the closed "on" position and a compact size of the disconnect device 50 is maintained. It is understood, however, that such mutually perpendicular axes of motion are not necessarily required for the sliding bar 72 and the interlock element 92. Other axes of movement are possible and may be adopted in alternative embodiments. On this note too, linear sliding movement is not necessarily required for these elements to function, and other types of movement (e.g., rotary or pivoting movement) may be utilized for these elements if desired.

Figure 4:
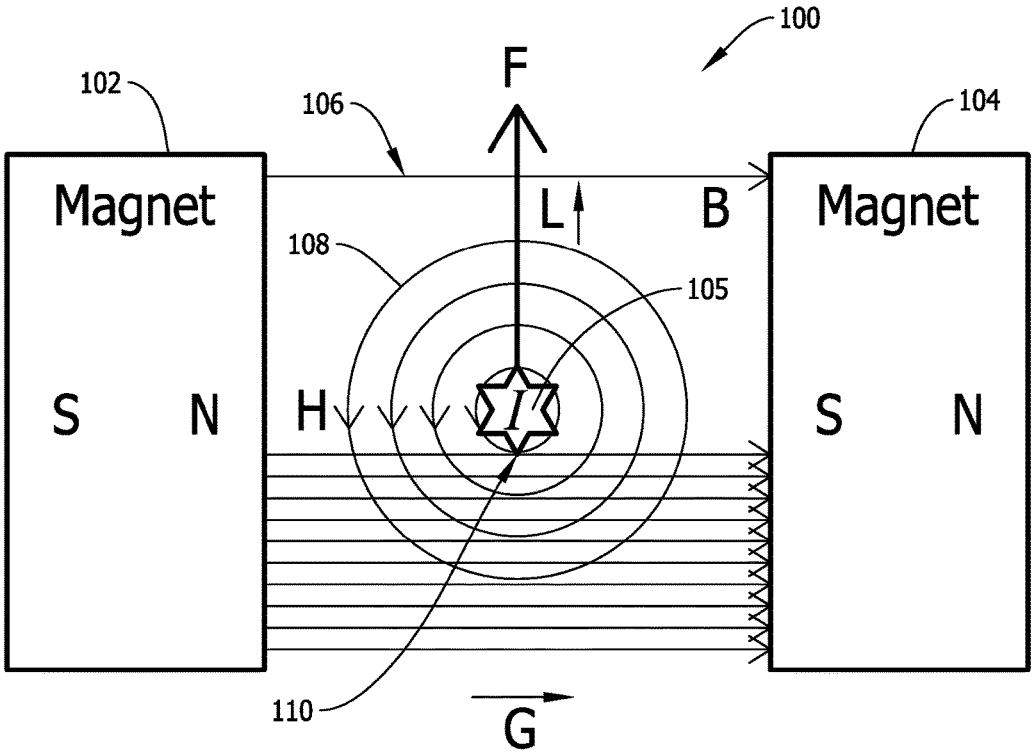
FIG. 4 is a schematic view of a portion of a magnet assembly for the fusible disconnect switch device shown in FIG. 2.

FIG. 4 is a schematic view of a portion of a magnet assembly 100 for the fusible disconnect switch device 50 to provide magnetic arc deflection that enhances performance capability in, for example, DC power systems operating above 125 VDC. The magnetic assembly 100 assists in quickly and effectively dissipating an increased amount of arc energy associated with electrical arcing as the switch contacts 74 and 76 are opened or closed that exceeds the ability of presently available compact fusible disconnect devices to reliably withstand. Using the principles of the magnetic assembly 100 described below, compact fusible disconnect devices 50 may be realized that may safely and reliable operate in electrical power systems operating at 125 VDC or greater, but potentially much greater voltages for use in DC voltage power systems operating at 400 VDC, 600 VDC and even 1000 VDC. The interrupting capability of the fusible disconnect device 50 accordingly may greatly increase via the implementation of the magnetic assembly 100.

As seen in FIG. 4, the magnet assembly 100 includes a pair of magnets 102, 104 arranged on each side of a conductor 105 that may correspond to a terminal in the device 50 described above. In contemplated embodiments, each magnet 102, 104 is a permanent magnet that respectively imposes a magnetic field 106 having a first polarity between the pair of magnets 102, 104, and the conductor 105 is situated in the magnetic field 106. As shown in FIG. 4, the magnet 102 has opposing poles S and N and the magnet 104 also has opposing poles S and N. Between the pole N of magnet 102 and the pole S of magnet 104 the magnetic field B also indicated as 106 is established and generally oriented in the direction of arrow G. The magnetic field B has a strength dependent on the properties and spacing of the magnets 102 and 104. The magnetic field B may be established in a desired strength depending on the magnets utilized. The magnetic field B in contemplated embodiments is constant and is maintained regardless of whether the switch contacts 74, 76 are opened or closed.

When electrical current I flows through the conductor 105 in a direction normal to the plane of the page of FIG. 4 and more specifically in a direction flowing out of the plane of the page of FIG. 4, a separate magnetic field 108 is induced and as shown in FIG. 4 the magnetic field 108 extends circumferentially around the conductor 105 in the direction of arrows H. The strength or intensity of the magnetic field 108 is, however, dependent on the magnitude of the current flowing through the conductor. The greater the current magnitude, the greater the strength of the magnetic field 108 that is induced. Likewise, when no current flows through the conductor 105, no magnetic field 108 is established.

Above the conductor 105 in the example illustrated in FIG. 4, the magnetic field 108 and the magnetic field 106 generally oppose one another and at least partly cancel one another, while below the conductor as shown in FIG. 4, the magnetic field 108 and the magnetic field 106 combine to create a magnetic field of increased strength and density. The concentrated magnetic field beneath the conductor 105 produces a mechanical force F acting on the conductor 105. The force F extends in the example shown in the direction of arrow L that is, in turn, directed normal to the magnetic field B 106. The force F may be recognized as a Lorenz force having magnitude F determined by the following relationship:

$$F=IL\times B \tag{1}$$

It should now be evident that the magnitude of the force can be varied by applying different magnetic fields, different amounts of current, and different lengths (L) of conductor 105. The orientation of the force F is shown to extend in the vertical direction in the plane of the page of FIG. 4, but in general can be oriented in any direction desired according to Fleming's Left Hand Rule, a known mnemonic in the field.

Briefly, Fleming's Left Hand Rule illustrates that when current flows in a wire (e.g., the conductor 105) and when an external magnetic field (e.g., the magnetic field B illustrated by lines 106) is applied across that flow of current, the wire experiences a force (e.g., the force F) that is oriented perpendicularly both to the magnetic field and also to the direction of the current flow. As such, the left hand can be held so as to represent three mutually orthogonal axes on the thumb, first finger and middle finger. Each finger represents one of the current I, the magnetic field B and the force F generated in response. As one illustrative example, and considering the example shown in FIG. 4, the first finger may represent the direction of the magnetic field B (e.g., to the right in FIG. 4), the middle finger may represent may represent the direction of flow of the current I (e.g., out of the page in FIG. 4), and the thumb represents the force F. Therefore, the first finger is pointed to the right and the middle finger is oriented out of the page in FIG. 4, and the position of the thumb reveals that the force F that results is oriented in the direction of arrow L (e.g., toward the top of the page in FIG. 4).

By orienting the current flow I in different directions through the magnetic field B, and also by orienting the magnetic field B in different directions, forces F extending in directions other than the arrow L can be generated. Within the switch housing 52 of the device 50 (FIGS. 2 and 3), magnetic forces F can accordingly be directed in particular directions. For example, and according to Fleming's Left Hand Rule, if the current flow I was directed into the paper instead of out of the paper as previously described in relation to the FIG. 4 while keeping the magnetic field B oriented as shown in FIG. 4 (i.e., toward the right in FIG. 4), the force F generated would be oriented in a direction opposite to the arrow L (i.e., toward the bottom of the page in FIG. 4). Likewise, if the magnetic field B was oriented vertically instead of horizontally as illustrated in FIG. 4, forces F could be generated in horizontal directions according to Fleming's Left Hand Rule instead of the vertically oriented forces of the preceding examples. Regardless, in the context of the disconnect switch devices 30 or 50 described, when the conductor 105 corresponds to a location of a switch contact 36 or 38 (FIG. 1) or a switch contact 74 or 76 (FIGS. 2 and 3), as the movable switch contact is opened or closed the force F can deflect the electrical arc 110 when it occurs and considerably reduce arcing time and severity.

Figure 5:
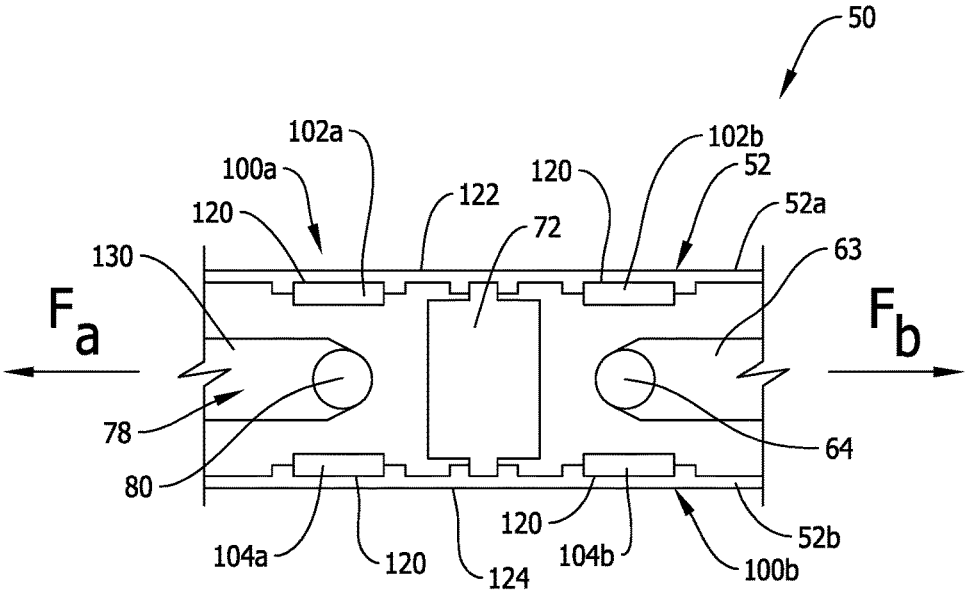
FIG. 5 is a partial top view of the switchable contact assembly for the fusible disconnect switch device shown in FIG. 2.

FIG. 5 is a partial top view of the switchable contact assembly for the exemplary fusible disconnect switch device 50 shown in FIGS. 2 and 3. In the assembly shown in FIG. 5, two magnet assemblies 100*a* and 100*b* are each respectively positioned around separate conductors (e.g., the terminals 78 and 63) having separate switch contacts 80 and 64. Specifically, magnets 102*a* and 104*a* of the first magnetic assembly 100*a* are positioned on either lateral side of the stationary switch contact 80 and the terminal conductor 78 and further are positioned on a first longitudinal side of the sliding actuator bar 72. The magnets 102*b* and 104*b* of the second magnetic assembly 100*b* are located on either lateral side of the stationary switch contact 64 and the terminal conductor 63 to which it is attached and further are positioned on a second longitudinal side of the sliding actuator bar 72 opposite the first longitudinal side.

The polarity of the magnets 102, 104 in each magnet pair 100*a*, 100*b* may be reversed or oppositely directed relative to one another to produce magnetic fields extending in opposing directions and hence generating oppositely directed forces $F_a$ and $F_b$ as determined by the relationship (1) set forth above. For example, the first pair of magnets 102*a*, 104*a* impose a first magnetic field having a first polarity and hence generates a magnetic field acting in a first direction (e.g., toward the top of the page in FIG. 5) as current flows though the contact 80 in a direction extending out of the page of FIG. 5. The second pair of magnets 102*b*, 104*b* may impose a magnetic field having a second polarity and hence generates a magnetic field acting in a second direction (e.g., toward the bottom of the page in FIG. 5) as current flows though the contact 64 in a direction extending into the page of FIG. 5. In accordance with Fleming's Left Hand Rule applied to each contact 80 and 64, the orientation of the magnetic fields in opposite directions, when combined with the induced magnetic fields associated with the current flow in each contact (which as noted above are also opposite directed in each contact 80 and 64), generates the forces $F_a$ and $F_b$ that extend in opposite directions 180° apart from one another as illustrated. An electrical arc occurring at the location of the contact 80 is therefore deflected in a first direction by the force $F_a$ while an electrical arc at the location of the contact 64 is deflected in a second direction by the force $F_b$ that is oriented oppositely to the first direction. The deflection of the arcs at each contact location via the forces $F_a$ and $F_b$ increases arc length and therefor reduces arc intensity and duration. As the movable switch contacts 74, 76 (FIG. 2) are separated from the stationary switch contacts 64 and 80, arc length is also increased and arc intensity is reduced and more quickly dissipates. The combined effect of the displacement of the switch contacts and the deflecting forces $F_a$ and $F_b$, as well as the arc division over two contact locations effectively facilitates dramatically higher DC voltage operation in a similar size package to existing fusible switch disconnect devices that cannot accommodate the arc energy issues of such higher voltage operation. As such, the compact size of the fusible disconnect switch device 50 is preserved while offering dramatically greater current interruption capability in higher voltage circuitry. The fusible disconnect switch device 50 including the magnets described can facilitate, for example, safe and reliable operation of the fusible disconnect switch device 50 in a 1000 VDC power system, about eight times greater than similar sized but conventional fusible disconnect switch devices that are safely and reliable operated in DC voltage systems of 125 VDC or less.

The arrangement shown in FIG. 5 is beneficial in the switch housing 52 because the electrical arc, and associated arc energy, is divided over the two locations of the contacts 80 and 64 when the movable contacts 74 and 76 are opened and closed, while the magnet assemblies 100*a*, 100*b* act upon the arcing locations in opposite directions with no risk of the arcs at each location combining. It shall be understood, however, that the magnet assemblies 100*a*, 100*b* could be polarized to produce forces $F_a$ and $F_b$ acting in the same direction as long as combining of the arcs could be precluded in another manner. At lower DC voltage levels, the arc division over two sets of contacts may be omitted in favor of a single set of contacts, and in such case a single pair of magnets may be used with similar effect. The dual pairs of switch contacts and dual pairs of magnets have been found advantageous as the DC voltage level increases above 125V, and sometimes well above 125 VDC to as much as 1000 VDC.

In contemplated embodiments the magnets 102*a*, 102*b*, 104*a* and 104*b* are permanent magnets, and more specifically are rare earth magnets such as neodymium magnets. In the example of FIG. 5, the magnets 102*a*, 102*b*, 104*a* and 104*b* are embedded in respective interior pockets 120 (also shown in FIG. 6) formed in the opposing sidewalls 122, 124 of the switch housing 52. In contemplated embodiments, the switch housing 52 may be formed as a split casing or from two housing pieces 52*a*, 52*b* that are joined to one another, with the pockets 120 being formed in each piece as shown. The magnets 102*a*, 102*b* are shown in FIG. 5 to extend in a generally coplanar relationship in the housing piece 52*a*, while the magnets 104*a*, 104*b* are shown in FIG. 5 to extend in a generally coplanar relationship in the housing piece 52*b*. The magnets 102*a*, 102*b* respectively extend relative to the magnets 104*a*, 104*b* in a spaced apart but parallel plane so that the magnetic fields are established between the magnets 102*a*, 104*a* and 102*b*, 104*b*.

Figure 6:
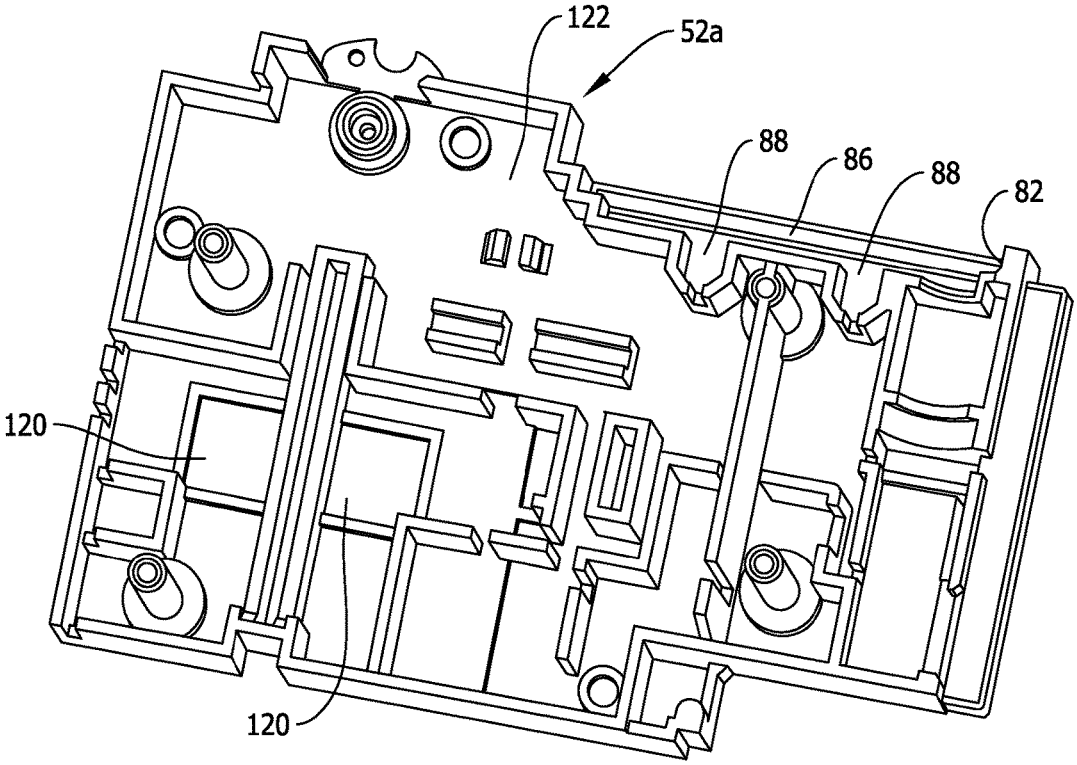
FIG. 6 is a perspective view of an exemplary housing piece for the fusible disconnect switch device shown in FIG. 2.

One of the housing pieces 52*a* is illustrated in FIG. 6 in which the pockets 120 are shown to be formed with and defined by protruding ribs in an injection molded housing piece 52*a*. The second housing piece 52*b* (FIG. 5) is complementary in shape and configuration, including but not limited to being formed with pockets 120 to the housing piece 52*a*. In lieu of ribs, pockets could alternatively be formed and defined with recessed surfaces. The pockets 120 as shown are generally defined to extend parallel to the major surface of the sidewalls 122, 124 of the housing pieces 52*a* and 52*b* such that when the magnets are installed in the pockets 120 the magnets extend generally parallel to the opposing sidewalls 122, 124 of the switch housing 52 as shown in FIG. 5. This too contributes to the compact size of the device 50, although other arrangements are possible.

In combination the housing pieces 52*a*, 52*b* enclose and protect the internal components shown in FIG. 2 and also the magnets 102*a*, 102*b*, 104*a* and 104*b* described when the housing pieces 52*a*, 52*b* are assembled and fastened together. In another embodiment, pockets similar the pockets 120 shown in FIGS. 5 and 6 may be formed on the exterior of housing pieces 52*a*, 52*b* instead of the interior pockets formed on the interior of the housing pieces as shown in FIGS. 5 and 6 and described above.

The magnets 102*a*, 102*b*, 104*a* and 104*b* may be fastened or secured in place in the pockets 120 in any known manner, and the magnets may be strategically selected in size and type, and also arranged and spaced relative to one another to produce a magnetic field of a desired strength between the magnets in each magnet pair. In general, stronger magnets 102*a*, 102*b*, 104*a* and 104*b* and therefor stronger magnetic fields may be desired as the DC voltage level of the circuit being opened and closed increases through the device 50. The magnets 102*a* and 104*a* used in the first magnet pair 100*a* may be the same or different type as the magnets 102*b* and 104*b* in the second magnet pair 100*b*. Likewise, the magnetic field strength established by the first magnet pair 100*a* may the same or different from the magnet pair 100*b*.

Figure 7:
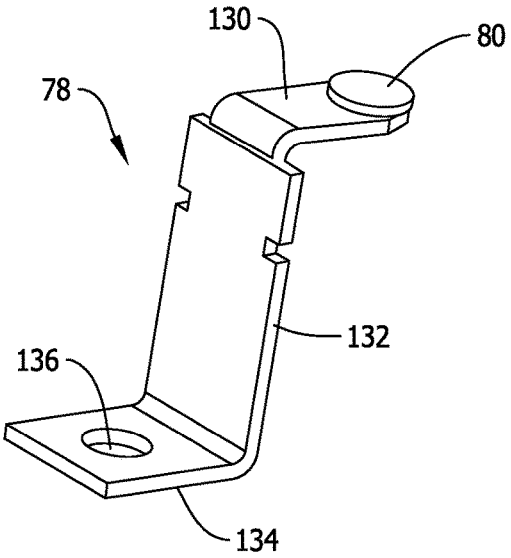
FIG. 7 is a perspective view of an exemplary line-side terminal for the fusible disconnect switch device shown in FIG. 2.

FIG. 7 is a perspective view of the line-side terminal 78 for the fusible disconnect switch device 50 (FIG. 2). The line-side terminal 78 may be formed with a planar upper section 130 to which the contact 80 is attached, an intermediate section 132 extending perpendicular to the upper section 130, and a planar lower section 134 extending perpendicular to the intermediate section 132 and the parallel to the upper section 130. The upper section 130 and the lower section 134, however, extend in opposite directions from the opposing ends of the intermediate section 132. The lower section 134 includes a through-hole 136 that may facilitate attachment of the lower section 136 to a bus-bar, for example at a location exterior to the switch housing 52.

In the arrangement shown in FIGS. 2 and 7, the terminal 78 is configured as a panel clip that facilitates use and attachment of the device 50 with a panelboard. As seen in FIG. 2, the lower section 134 of the panel clip depends from the lower left hand bottom corner of the device 50 and may therefore be recessed in the panelboard assembly while still facilitating convenient installation to the panelboard, while the load-side terminal 66 is elevated in the switch housing 52 relative to the lower section 134 and is also accessible from the side edge of the switch housing to connect a load-side or conductor of the load-side circuit 24. Unlike the connection to the line-side circuit 22 that is made outside the switch housing 52 via the lower section 134, the connection to the load-side circuit 24 is established at a location within the switch housing via the load-side terminal 66. Having the line and load-side terminals of different types and relatively different locations or positions in the switch housing 52 in this example is therefore beneficial for certain panelboard applications. In some embodiments, however, these features may be considered optional.

Figure 8:
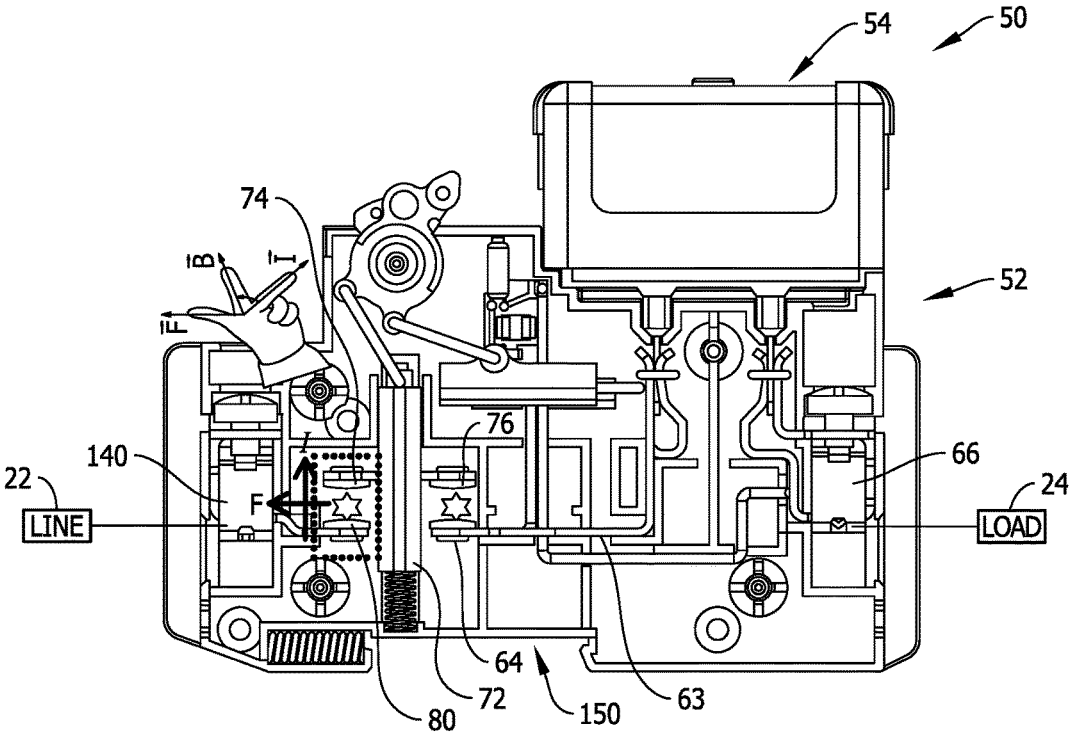
FIG. 8 is a partial longitudinal side elevational view of a second embodiment of a fusible disconnect switch device for the electrical power distribution system shown in FIG. 1.

FIG. 8 is a partial longitudinal side elevational view of a second embodiment of a fusible disconnect switch device 50 for the electrical power distribution system shown in FIG. 1 that is similar to the embodiment described above in relation to FIGS. 2 and 3 in most aspects. The embodiment of FIG. 8 includes a line-side terminal 140 in the form of a box lug terminal that is situated opposite the load-side terminal 66 that is likewise configured as a box lug terminal. Unlike the embodiment shown in FIG. 2, the connections to the line and load-side circuitry 22, 24 are respectively established inside the switch housing 52 on the opposing sides of the device 50, but in similar positions on each side. Various other line and load-side terminal types and positions are possible, however, and may alternatively be utilized.

The switch housing 52 in the embodiment of FIG. 8, unlike the previous embodiments, is configured with a DIN rail slot 150 for ease of installation with a known DIN rail (not shown). That is, the panel mount clip shown in FIGS. 2 and 7 is omitted in favor of the DIN rail slot 150. Other mounting and installation options could be provided in still further and/or alternative embodiments.

The embodiment of FIG. 8 is likewise provided with magnetic arc deflection magnets to produce the force F to deflect an electrical arc toward as described above. In the upper left hand corner of FIG. 8, Fleming's Left Hand Rule is illustrated with the thumb of the hand pointing in the direction of arrow F corresponding to the deflection force generated. Like the previous embodiments, the force F shown in FIG. 8 is directed along an axis that is generally perpendicular to the axis of the sliding bar 72. That is, while the sliding bar 72 moves along a vertical axis in the illustration of FIG. 8, the force F is oriented in a generally horizontal direction, while the magnetic field of the magnets is in this figure oriented into the plane of the page. In other cases, however, the arc deflection force F could be established in another direction relative to the axis of the sliding bar 72.

Figure 9:
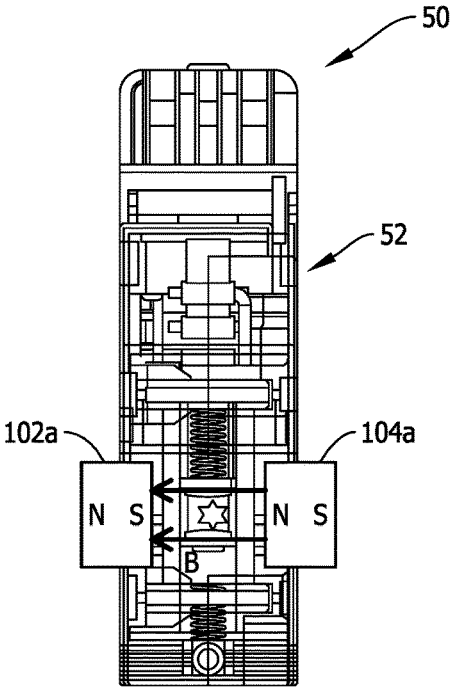
FIG. 9 is a partial lateral sectional view of the fusible disconnect switch device shown in FIG. 8.

FIG. 9 is a partial lateral sectional view of the fusible disconnect switch device 50 shown in FIG. 8. Magnets 102*a* and 104*a* are seen to extend partly inside and partly outside the switch housing 52, but nonetheless operate with similar effect to the embodiments described above to facilitate switching capability at DC voltages of 400 VDC, 600 VDC, and even 1000 VDC.

In certain contemplated embodiments, the magnets 102*a*, 104*a* could be applied entirely outside the switch housing 52 and held in place via magnetic attraction. Some care should be taken, however, if the magnetic strength is insufficient to reliably hold the magnets in place, as the magnetic arc defection could be compromised if the magnets were removed or displaced in a manner that would impair the desired Lorentz force from being established to deflect an arc.

The benefits and advantages of the inventive concepts are now believed to have been amply illustrated in relation to the exemplary embodiments disclosed.

An embodiment of a fusible disconnect switch device has been disclosed including: a nonconductive switch housing configured to accept an overcurrent protection fuse; a current path defined in the nonconductive switch housing, the current path comprising: a first fuse contact member and a second fuse contact member, the first fuse contact member and the second fuse contact member configured to complete an electrical connection through the overcurrent protection fuse; and a first switch contact connected to the first fuse contact member; a rotary actuator configured to move the first switch contact between an opened position and a closed position to complete or open the current path; and a first magnet and a second magnet disposed about the first switch contact, wherein the first and second magnets establish a first magnetic field therebetween and wherein the first switch contact is in the magnetic field.

Optionally, the current path further may include a second switch contact spaced from the first switch contact in the nonconductive switch housing. The first and second switch contacts may be mounted stationary in the nonconductive switch housing. The fusible disconnect switch may further include third and fourth magnets disposed about the second switch contact, wherein the third and fourth magnets establish a second magnetic field therebetween and wherein the second switch contact is in the second magnetic field. The first magnetic field may have a first polarity, and the second magnetic field may have a second polarity opposite to the first polarity. The first and second magnets may be permanent magnets, and more specifically may be rare earth magnets, and even more specifically may be neodymium magnets.

The fusible disconnect switch device may also include a sliding actuator bar, with the first and second movable switch contacts coupled to the sliding actuator bar. The sliding actuator bar may be movable along a first axis. The first magnetic field may be established along a second axis perpendicular to the first axis. The first and second magnet may be disposed on a first side of the sliding actuator bar, and the device may further include third and fourth magnets situated on a second side of the sliding actuator bar.

The overcurrent protection fuse may include a pair of terminal blades insertable into the switch housing along an insertion axis. The first magnetic field may be established along a second axis perpendicular to the insertion axis.

The fusible switch disconnect device may also include a third magnet, the first magnet and the third magnet extending generally coplanar to one another.

The fusible switch disconnect device of claim 14, wherein the first magnet and second magnet respectively extend in spaced apart but parallel planes, and wherein the at least one switch contact is disposed between the first magnet and the second magnet. The first and second magnets may be internal to the nonconductive switch housing. The nonconductive switch housing may define at least one pocket that receives at least one of the first and second magnets. The current path may further include a line-side terminal and a load-side terminal for establishing a respective electrical connection to line-side and load-side circuitry. The first and second magnets may be situated proximate the line-side terminal. At least one of the line-side terminal and load-side terminal may include a panel mount clip.

The fusible switch disconnect device may further include a nonconductive terminal cover movable by the rotary switch actuator between a first position and a second position. The fusible switch disconnect device of claim may also include a switch interlock shaft coupled to the switch actuator. Each of the first and second fuse contact members comprises a fuse clip configured to engage a terminal blade of the overcurrent protection fuse.

An embodiment of a fusible disconnect switch device has also been disclosed including: a nonconductive housing defining an exterior fuse receptacle and a first terminal blade opening and second terminal blade opening formed through the housing; a line-side terminal in the nonconductive housing; a line-side fuse terminal proximate the first terminal blade opening; at least one switch contact associated with at least one of the line-side terminal and the line-side fuse terminal; a switch actuator selectively positionable to move the switch contact between a closed position completing an electrical path from the line-side terminal to the line-side fuse terminal and an open position disconnecting the line-side contact from the line-side fuse terminal; and at least one pair of magnets imposing a magnetic field across the at least one switch contact.

Optionally, the fusible switch disconnect device may also include a retractable fuse insertable into the fuse receptacle, the fuse including a first terminal blade and a second terminal blade, the first terminal blade passing through the first terminal blade opening and establishing a line-side electrical connection to the line-side fuse terminal. The fuse may project from the fuse receptacle when the first terminal blade is passed through the first terminal blade opening. The retractable fuse may be a rectangular fuse module The fuse may be open and accessible on an outer surface of the housing.

The at least one switch contact may include a first switch contact associated with the line-side terminal and a second switch contact associated with the line-side fuse terminal, and wherein the at least one pair of magnets comprises a first pair of magnets and a second pair of magnets spaced from one another, the first pair of magnets imposing a first magnetic field across the first switch contact and the second pair of magnets imposing a second magnetic field across the second switch contact. The first magnetic field may have a first polarity, and the second magnetic field may have a second polarity opposite to the first polarity. The at least one pair of magnets may comprise permanent magnets. The at least one pair of magnets may also be rare earth magnets. The at least one pair of magnets may also be neodymium magnets.

An embodiment of a fused disconnect switch has also been disclosed including: a nonconductive housing defining a fuse receptacle and first and second fuse contact members in the fuse receptacle; a line-side terminal carrying a first stationary contact; a line-side fuse terminal proximate the first terminal blade opening and comprising a second stationary contact; a switch actuator selectively positionable between a closed position and an open position; a sliding bar coupled to the actuator and carrying first and second movable switch contacts, the first and second switch contacts completing an electrical path from the line-side terminal to the line-side fuse terminal when the switch is in the closed position and disconnecting the line-side contact from the line-side fuse terminal when the switch actuator is in the opened position; and at least one pair of magnets imposing a magnetic field proximate at least one of the first and secondary stationary contacts, wherein an arc deflecting force is generated when the electrical path is disconnected.

Optionally, the at least one pair of magnets may comprise a first pair of magnets and a second pair of magnets, the first pair of magnets imposing a first magnetic field proximate the first stationary contact and the second pair of magnets imposing a second magnetic field proximate at least one of the first and secondary stationary contacts. The first magnetic field may have a first polarity, and the second magnetic field may have a second polarity opposite to the first polarity. The first and second pairs of magnets may include a first and second pair of permanent magnets. The first and second pairs of permanent magnets may include a first and second pair of rare earth magnets, and the first and second pair of rare earth magnets may include a first and second pair of neodymium magnets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compact disconnect switch device comprising:

a nonconductive switch housing including in combination:

a line-side terminal and a load-side terminal;

a first fuse terminal and a second fuse terminal each being configured to receive and accept respective terminal elements of an overcurrent protection fuse and therefore establish an electrical connection through the overcurrent protection fuse;

a mechanical switch located between the line side terminal and the first fuse terminal, the mechanical switch including dual pairs of switch contacts operable to connect or disconnect the line-side terminal and the first fuse terminal without disturbing the overcurrent protection fuse; and dual pairs of permanent magnets establishing respective magnetic fields therebetween and across each of the dual pairs of switch contacts to reduce electrical arcing intensity and duration while being operated to connect or disconnect the line-side terminal and the first fuse terminal;

wherein the dual pairs of permanent magnets ensure safe operation of the disconnect switch in an energized direct current electrical power system having an operating voltage exceeding 125V.

2. The compact fusible disconnect switch device of claim 1, wherein the dual pairs of switch contacts includes a first switch contact and a second switch contact linked to one another and being simultaneously movable along a linear axis within the nonconductive switch housing to connect or disconnect the first fuse terminal from the line-side terminal.

3. The compact fusible disconnect switch device of claim 1, wherein the dual pairs of permanent magnets respectively establish a first magnetic field having a first polarity across one of the dual pairs of switch contacts, and a second magnetic field having a second polarity dual across the other of the dual pairs of switch contacts, the first polarity being opposite to the first polarity.

4. The compact fusible disconnect switch device of claim 3, wherein the dual pairs of permanent magnets comprise dual pairs of rare earth magnets.

5. The compact fusible disconnect switch device of claim 4, wherein the dual pairs of rare earth magnets comprise dual pairs of neodymium magnet.

6. The compact fusible disconnect switch device of claim 1, further comprising a sliding actuator bar being movable along a first linear axis in the nonconductive switch housing, the sliding bar separating the dual pairs of switch contacts and the dual pairs of the dual pairs of permanent magnets.

7. The compact fusible disconnect switch device of claim 6, wherein the respective magnetic fields are each established along a second axis perpendicular to the first linear axis.

8. The compact fusible switch disconnect device of claim 1, wherein the overcurrent protection fuse includes a fuse housing and a pair of terminal blades extending from the housing, the pair of terminal blades being insertable into the first fuse terminal and the second fuse terminal along a first axis, and at least a portion of the fuse housing being exposed from the nonconductive switch housing when the overcurrent protection fuse is inserted.

9. The compact fusible switch disconnect device of claim 8, wherein the respective magnetic fields are established along a second axis perpendicular to the first axis.

10. The compact fusible switch disconnect device of claim 1, wherein the dual pairs of permanent magnets are internal to the nonconductive switch housing.

11. The compact fusible switch disconnect device of claim 10, wherein the nonconductive switch housing defines pockets that respectively receive the dual pairs of permanent magnets.

12. The compact fusible switch disconnect device of claim 1, wherein the dual pairs of switch contacts includes a switch contact that is attached to the line-side terminal.

13. The compact fusible switch disconnect device of claim 1, wherein the dual pairs of permanent magnets establish respective magnetic fields therebetween and across a portion of each of the dual pairs of switch contacts to reduce electrical arcing intensity and duration while being engaged or disengaged in the energized direct current electrical power system at an operating voltage of 400 VDC, 600 VDC, or 1000 VDC.

14. A compact fusible disconnect switch device comprising:

a housing having an upper surface configured to accept a least a portion of an overcurrent protection fuse having first and second terminal blades;

a current path defined in the housing and including fuse terminals connecting to the first and second terminal blades;

a rotary switch actuator extending from an upper surface of the housing;

a sliding bar linked to the rotary switch actuator and constrained to move along a linear axis in the nonconductive housing;

dual mechanical switch contacts in the housing and responsive to a position of the sliding bar between engaged and disengaged positions, the dual mechanical switch contacts connecting in series to the overcurrent protection fuse when the dual switch contacts are in the engaged position; and a set of magnets imposing respective magnetic fields across each of the dual mechanical switch contacts to safely reduce electrical arcing and intensity in the engagement and disengagement of the dual switch contacts in an energized direct current electrical power system having an operating voltage exceeding 125V.

15. The compact fusible switch disconnect device of claim 14, wherein the dual mechanical switch contacts comprise a first stationary contact and a second stationary contact spaced from one another in the housing, and a first movable contact and a second movable contact linked to one another and completing a series connection between the first stationary contact and the second stationary contact.

16. The compact fusible switch disconnect device of claim 15, wherein the first movable contact and the second movable contact are carried by the sliding bar and simultaneously positionable along the linear axis in the housing in a space between the rotary switch actuator and the first and second stationary contacts.

17. The compact fusible switch disconnect device of claim 15, wherein the set of magnets comprises a first pair of magnets establishing in combination a first magnetic field across the first stationary contact, and a second pair of magnets establishing in combination a second magnetic field across the second stationary contact.

18. The compact fusible switch disconnect device of claim 17, wherein the first and second fields are established with opposite polarity.

19. The compact fusible switch disconnect device of claim 14, wherein the set of magnets imposing respective magnetic fields across each of the dual mechanical switch contacts to safely reduce electrical arcing and intensity in the engagement and disengagement of the dual mechanical switch contacts in an energized direct current electrical power system having an operating voltage of 400 VDC, 600 VDC, or 1000 VDC.

20. A compact fused disconnect switch comprising:

a housing defining a fuse receptacle dimensioned to receive at least a portion of an overcurrent protection fuse, the fuse receptacle including a pair of fuse terminals configured to accept and complete an electrical connection through the overcurrent protection fuse;

an actuator projecting from the housing;

a circuit path enclosed in the compact housing and including a mechanical switch, the mechanical switch including dual stationary switch contacts gapped from one another and dual movable switch contacts, the dual movable switch contacts linked to the actuator and to one another for simultaneous movement thereof along a linear axis in a space between the dual stationary switch contacts and the actuator to disconnect or connect the dual stationary switch contacts in series with the overcurrent protection fuse without removing the overcurrent protection from the fuse receptacle; and a first pair of permanent magnets and a second pair of permanent magnets coupled to the compact housing and respectively arranged about the dual stationary switch contacts to respectively generate magnetic fields of opposite polarity and thereby produce oppositely directed arc deflecting forces across each one of the dual stationary switch contacts to effectively reduce electrical arcing intensity and duration when the dual movable switch contacts are being repositioned under an electrical power system operating voltage of 400 VDC, 600 VDC, or 1000 VDC.

* * * * *